US012716659B2

(12) United States Patent
Xie et al.

(10) Patent No.: US 12,716,659 B2
(45) Date of Patent: Aug. 25, 2026

(54) ENERGY STORAGE DEVICE AND METHOD BASED ON CARBON DIOXIDE GAS-LIQUID PHASE CHANGE

(71) Applicant: EXA ENERGY TECHNOLOGY (SHENZHEN) CO. LTD., Shenzhen (CN)

(72) Inventors: Yonghui Xie, Shenzhen (CN); Qin Wang, Shenzhen (CN); Lei Sun, Shenzhen (CN); Yuqi Wang, Shenzhen (CN); Di Zhang, Shenzhen (CN); Yongliang Guo, Shenzhen (CN); Xiaoyong Wang, Shenzhen (CN); Feng Yang, Shenzhen (CN)

(73) Assignee: EXA ENERGY TECHNOLOGY (SHENZHEN) CO. LTD., Shenzhen (CN)

( * ) Notice: Subject to any disclaimer, the term of this patent is extended or adjusted under 35 U.S.C. 154(b) by 515 days.

(21) Appl. No.: 18/254,951

(22) PCT Filed: Dec. 8, 2021

(86) PCT No.: PCT/CN2021/136391
§ 371 (c)(1),
(2) Date: May 30, 2023

(87) PCT Pub. No.: WO2022/166387
PCT Pub. Date: Aug. 11, 2022

(65) Prior Publication Data

US 2024/0019216 A1 Jan. 18, 2024

(30) Foreign Application Priority Data

Feb. 7, 2021 (CN) ..... 202110179673.8

(51) Int. Cl.
*F28D 20/02* (2006.01)
*F28D 20/00* (2006.01)

(52) U.S. Cl.
CPC .... *F28D 20/021* (2013.01); *F28D 2020/0078* (2013.01); *F28D 2020/0091* (2013.01)

(58) Field of Classification Search
CPC ..... F28D 20/02; F28D 20/028; F28D 20/021; F28D 2020/0078; F28D 2020/0091;
(Continued)

(56) References Cited

U.S. PATENT DOCUMENTS

2004/0131516 A1* 7/2004 Jackson ..... C01B 32/50 422/198
2022/0021336 A1* 1/2022 Younes ..... F24S 10/00

FOREIGN PATENT DOCUMENTS

CN 103452612 A 12/2013
CN 104533556 A 4/2015
(Continued)

OTHER PUBLICATIONS

International Search Report and Written Opinion from International Application No. PCT/CN2021/136391 mailed Feb. 28, 2022.
(Continued)

*Primary Examiner* — Harry E Arant
(74) *Attorney, Agent, or Firm* — Ballard Spahr LLP

(57) ABSTRACT

An energy storage device and method based on carbon dioxide gas-liquid phase change. The energy storage device based on carbon dioxide gas-liquid phase change comprises: a gas storage (100); a liquid storage tank (200); an energy storage assembly (300), the energy storage assembly (300) being arranged between the gas storage (100) and the liquid storage tank (200), and carbon dioxide being changed from a gas state to a liquid state through the energy storage assembly (300); an energy release assembly (400), the
(Continued)

energy release assembly (400) being arranged between the gas storage (100) and the liquid storage tank (200), and the carbon dioxide being changed from the liquid state to the gas state through the energy release assembly (400); a heat exchange assembly (500), the energy storage assembly (300) and the energy release assembly (400) being both connected to the heat exchange assembly (500), and the heat exchange assembly (500) being capable of transferring some of the energy generated in the energy storage assembly (300) to the energy release assembly (400); and a heat recovery assembly, at least one of energy released when the carbon dioxide is changed from the gas state to the liquid state, energy released when the carbon dioxide is cooled before entering the gas storage (100), and energy released when a heat exchange medium is cooled being recovered by the heat recovery assembly and used for evaporation of the carbon dioxide. The device can reduce energy waste in storage and release processes and improve the energy utilization rate.

16 Claims, 4 Drawing Sheets

(58) Field of Classification Search
CPC ..... F25B 1/053; F25B 25/005; F25B 40/00; F25B 2339/047; F25B 2309/06; F25B 2400/16; F25B 2400/14
See application file for complete search history.

(56) References Cited

FOREIGN PATENT DOCUMENTS

| | | | | | |
|---|---|---|---|---|---|
| CN | 206256940 | U | | 6/2017 | |
| CN | 108562081 | A | | 9/2018 | |
| CN | 109441741 | A | | 3/2019 | |
| CN | 109630220 | A | | 4/2019 | |
| CN | 109826682 | A | | 5/2019 | |
| CN | 109944773 | A | | 6/2019 | |
| CN | 110374838 | A | | 10/2019 | |
| CN | 111749743 | A | | 10/2020 | |
| CN | 112325497 | A | * | 2/2021 | ..... F01D 15/10 |
| CN | 112880451 | A | | 6/2021 | |
| CN | 112985142 | A | | 6/2021 | |
| CN | 112985143 | A | | 6/2021 | |
| CN | 112985144 | A | | 6/2021 | |
| CN | 112985145 | A | | 6/2021 | |
| KR | 20160060207 | A | | 5/2016 | |
| WO | 2015154894 | A1 | | 10/2015 | |

OTHER PUBLICATIONS

Wang, "The Science of Essential Oils", Dec. 31, 2018, p. 56.

* cited by examiner

ENERGY STORAGE DEVICE AND METHOD BASED ON CARBON DIOXIDE GAS-LIQUID PHASE CHANGE

CROSS-REFERENCE TO RELATED APPLICATIONS

This application is a U.S. National stage of International Application No. PCT/CN2021/136391 filed on Dec. 8, 2021, which claims priority to Chinese Patent Applications No. 2021101796738, filed on Feb. 7, 2021. The entire contents of each of the above-identified applications are incorporated herein in their entireties.

TECHNICAL FIELD

This disclosure relates to the field of energy storage technology, and in particular, to an energy storage device and method based on carbon dioxide gas-liquid phase change.

BACKGROUND

With the development of society and economy, people's demand for energy sources is getting higher and higher. However, the increase in energy source consumption makes environmental problems more serious, and the non-renewable conventional energy sources such as coal and oil are becoming increasingly depleted, so it becomes an inevitable choice to vigorously develop new energy sources such as solar energy and wind energy to slow down consumption of the conventional energy sources. Due to intermittent and fluctuating characteristics of new energy sources, direct grid connection may cause a certain impact on the power grid, and it is difficult to maintain consistency between the time when users use electric energy and the time when the renewable energy generates electric energy. Therefore, storage of electric energy is of great significance to optimization and regulation of the energy source system.

Among existing energy storage technologies, pumped storage is dependent on specific geological conditions and requires an adequate source of water; electrochemical energy storage and electromagnetic energy storage have limitations in scenarios with low energy storage scale and high safety requirements; conventional compressed air energy storage relies on fossil energy, while adiabatic compressed air energy storage does not require fossil energy but is under high pressure, so the equipment design and manufacture thereof are difficult and costly, and large-scale gas storage spaces (such as rock caves, abandoned mines, etc.) are also required, therefore the required basic conditions are tough.

In related technologies, there is a way to store energy by compressing carbon dioxide. The main principle thereof is to compress and store the carbon dioxide through excess power output from the power plant during the trough period of electricity consumption. During the peak period of electricity consumption, the carbon dioxide is released and applies work through the turbine. However, some current carbon dioxide energy storage systems have a relatively high energy waste and low energy utilization in the process of storing and releasing energy.

SUMMARY

Accordingly, in order to solve the main technical problems existing in the aforementioned conventional energy storage system, the present disclosure proposes an energy storage device based on carbon dioxide gas-liquid phase change, which can reduce energy waste in the storage and release process when storing and releasing energy through the device, thereby improving energy utilization.

An energy storage device based on carbon dioxide gas-liquid phase change includes a gas storage reservoir , a liquid storage tank, an energy storage assembly, an energy release assembly, a heat exchange assembly and a heat recovery assembly.

The gas storage reservoir is configured to store carbon dioxide in a gas state. A volume of the gas storage reservoir is changeable.

The liquid storage tank is configured to store carbon dioxide in a liquid state.

The energy storage assembly is configured to store energy and is arranged between the gas storage reservoir and the liquid storage tank. The carbon dioxide is changed from the gas state to the liquid state by the energy storage assembly.

The energy release assembly is configured to release energy and arranged between the gas storage reservoir and the liquid storage tank. The carbon dioxide is changed from the liquid state to the gas state by the energy release assembly.

The energy storage assembly and the energy release assembly are both connected to the heat exchange assembly. A heat exchange medium flows in the heat exchange assembly. The heat exchange assembly is capable of transferring part of energy generated in the energy storage assembly to the energy release assembly.

At least one of the energy released when the carbon dioxide is changed from the gas state to the liquid state, the energy released when the carbon dioxide is cooled before entering the gas storage reservoir, and the energy released when the heat exchange medium is cooled, is capable of being recovered by the heat recovery assembly and used in evaporation of the carbon dioxide.

In one of the embodiments, the energy release assembly includes an evaporator. The carbon dioxide is changed from the liquid state to the gas state through the evaporator. The heat recovery assembly is connected to the evaporator.

In one of the embodiments, the energy storage assembly includes a condenser. The carbon dioxide changes from the gas state to the liquid state through the condenser. The condenser is connected to the heat recovery assembly.

In one of the embodiments, the energy release assembly further includes a throttle expansion valve located between the liquid storage tank and the evaporator, and the throttle expansion valve is configured to expand and depressurize the carbon dioxide flowing out of the liquid storage tank.

In one of the embodiments, the evaporator and the condenser is capable of being combined to form a phase change heat exchanger.

In one of the embodiments, the energy release assembly further includes an energy release cooler configured to cool the carbon dioxide entering the gas storage reservoir, and the energy release cooler is connected to the heat recovery assembly.

In one of the embodiments, the energy storage assembly includes a condenser and a compressed energy storage part. There is at least one compressed energy storage part. The compressed energy storage part includes a compressor and an energy storage heat exchanger. The energy storage heat exchanger is connected to the compressor in each compressed energy storage part. The energy storage heat exchanger in each compressed energy storage part is connected to the compressor in an adjacent compressed energy storage part. The compressor in the compressed energy storage part at the starting end is connected to the gas storage reservoir. The energy storage heat exchanger in the compressed energy storage part at the tail end is connected to the condenser. The liquid storage tank is connected to the condenser. The heat exchange assembly is connected to the energy storage heat exchanger. The energy storage heat exchanger is capable of transferring part of energy generated during the compression of carbon dioxide by the compressor to the heat exchange assembly.

In one of the embodiments, the energy release assembly includes an evaporator, an expansion energy release part and an energy release cooler. There is at least one expansion energy release part. The expansion energy release part includes an energy release heat exchanger and an expander. The expander is connected to the energy release heat exchanger in each expansion energy release part. The expander in each expansion energy release part is connected to the energy release heat exchanger in an adjacent expansion energy release part. The evaporator is connected to the liquid storage tank. The energy release heat exchanger in the expansion energy release part at a starting end is connected to the evaporator. The expander in the expansion energy release part at a tail end is connected to the energy release cooler. The gas storage reservoir is connected to the energy release cooler. The heat exchange assembly is connected to the energy release heat exchanger. The carbon dioxide flowing through the energy release heat exchanger is capable of absorbing energy temporarily stored in the heat exchange assembly.

In one of the embodiments, the heat exchange assembly includes a cold storage tank and a heat storage tank. The cold storage tank and the heat storage tank are provided with the heat exchange medium. The cold storage tank and the heat storage tank form a heat exchange circuit between the energy storage assembly and the energy release assembly. The heat exchange medium is capable of flowing in the heat exchange circuit. The heat exchange medium is capable of storing part of energy generated by the energy storage assembly when the heat exchange medium flows from the cold storage tank to the heat storage tank. The heat exchange medium is capable of transferring the stored energy to the energy release assembly when the heat exchange medium flows from the heat storage tank to the cold storage tank.

In one of the embodiments, the heat exchange assembly further includes a heat exchange medium cooler. The heat exchange medium cooler is configured to cool the heat exchange medium entering the cold storage tank. The heat exchange medium cooler is connected to the heat recovery assembly.

In one of the embodiments, an auxiliary heating element is provided between the cold storage tank and the heat storage tank. Part of the heat exchange medium is capable of being heated by the auxiliary heating element and then flowing into the heat storage tank.

In one of the embodiments, the heat recovery assembly includes an intermediate storage element and recovery pipelines. The intermediate storage element is connected to the evaporator through part of the recovery pipelines. At least one of the energy released when the carbon dioxide is changed from the gas state to the liquid state, the energy released when the carbon dioxide is cooled before entering the gas storage reservoir, and the energy released when the heat exchange medium is cooled, is capable of reaching the intermediate storage element through part of the recovery pipelines.

In one of the embodiments, the gas storage reservoir is a flexible pneumatic membrane gas storage reservoir.

The aforementioned energy storage device based on carbon dioxide gas-liquid phase change is provided with the gas storage reservoir and the liquid storage tank. The carbon dioxide in the gas state is stored in the gas storage reservoir, and the carbon dioxide in the liquid state is stored in the liquid storage tank. The Energy storage assembly and the energy release assembly are provided between the gas storage reservoir and the liquid storage tank. The heat exchange assembly is further provided between the energy release assembly and the energy storage assembly. The carbon dioxide is changed from the gas state to the liquid state through the energy storage assembly, and is changed from the liquid state to the gas state through the energy release assembly. When the carbon dioxide reaches the liquid storage tank from the gas storage reservoir through the energy storage assembly, the energy storage is completed. Part of the energy is stored in the carbon dioxide, and part of the energy is stored in the heat exchange assembly, and transferred to the energy release assembly, and the energy release is completed through the energy release assembly. At least one of the energy released when the carbon dioxide is changed from the gas state to the liquid state, the energy released when the carbon dioxide is cooled before entering the gas storage reservoir, and the energy released when the heat exchange medium is cooled, is capable of being recovered by the heat recovery assembly and used in the change of the carbon dioxide from the liquid state to the gas state. That is, part of the excess energy inside is capable of being recovered and used in the change of the carbon dioxide from the liquid state to the gas state. By recovering the excess energy inside, the energy waste can be reduced and the energy utilization can be improved.

The present disclosure also proposes an energy storage method based on carbon dioxide gas-liquid phase change, which can reduce the energy waste in the storage and release process and improve the energy utilization.

The energy storage method based on carbon dioxide gas-liquid phase change includes an energy storage step and an energy release step.

In the energy storage step, carbon dioxide is changed from a gas state to a liquid state, and part of energy is stored in a heat exchange medium.

In the energy release step, carbon dioxide is changed from the liquid state to the gas state. The energy stored in the heat exchange medium is released through the carbon dioxide. At least one of energy released when the carbon dioxide is changed from the gas state to the liquid state, energy released when the carbon dioxide is cooled before entering the gas storage reservoir, and energy released when the heat exchange medium is cooled, is used in evaporation of the carbon dioxide.

In one of the embodiments, the energy release step and the energy storage step are performed simultaneously.

In the aforementioned energy storage method based on carbon dioxide gas-liquid phase change, during the energy storage process, the carbon dioxide is changed from the gas state to the liquid state, and part of the energy generated is stored in the heat exchange medium, and this part of energy is released during the energy release process. At least one of the energy released when the carbon dioxide is changed from the gas state to the liquid state, the energy released when the carbon dioxide is cooled before entering the gas storage reservoir, and the energy released when the heat exchange medium is cooled, is used in the change of the carbon dioxide from the liquid state to the gas state. That is, part of the excess energy can be recovered for use, thereby reducing the energy waste and improving the energy utilization.

Figure 1:
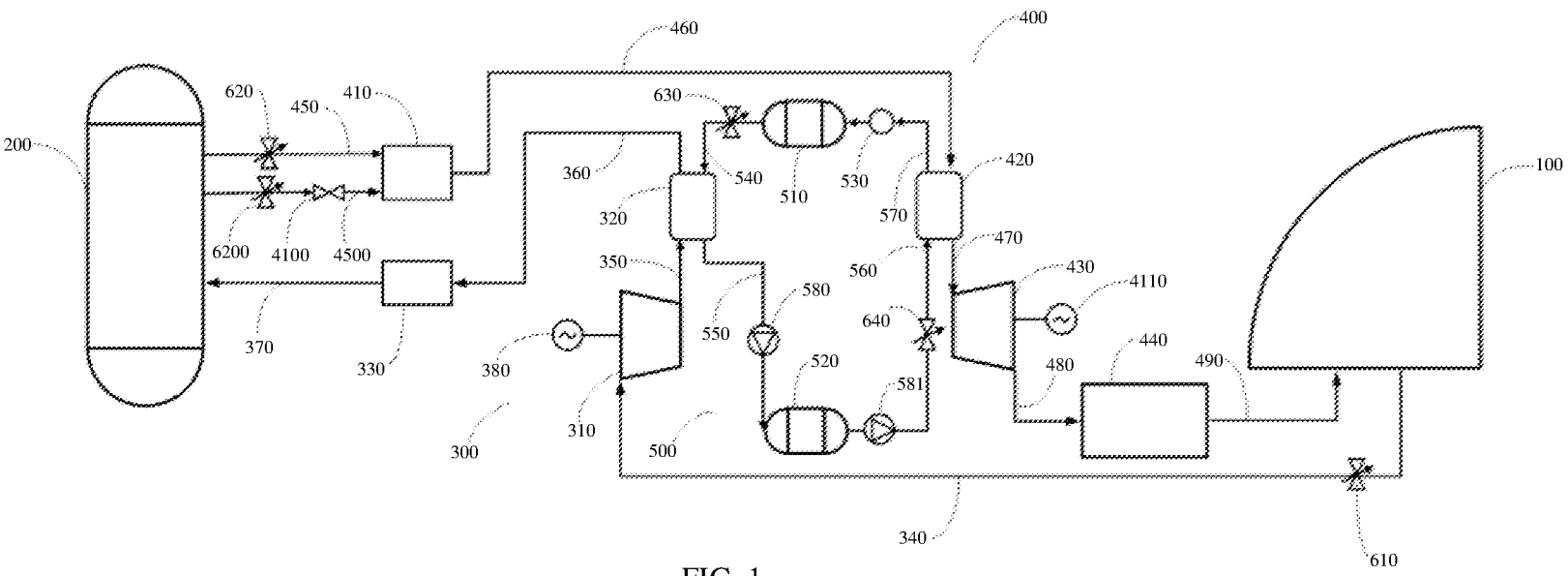
FIG. 1 is a schematic structural diagram of an energy storage device based on carbon dioxide gas-liquid phase change in an embodiment of the present disclosure.

REFERENCE SIGNS gas storage reservoir 100, liquid storage tank 200, energy storage assembly 300, compressor 310, energy storage heat exchanger 320, condenser 330, first energy storage pipeline 340, second energy storage pipeline 350, third energy storage pipeline 360, fourth energy storage pipeline 370, motor 380, energy release assembly 400, evaporator 410, energy release heat exchanger 420, expander 430, energy release cooler 440, first energy release pipeline 450, second energy release pipeline 460, third energy release pipeline 470, fourth energy release pipeline 480, fifth energy release pipeline 490, throttle expansion valve 4100, electric generator 4110, sixth energy release pipeline 4500, heat exchange assembly 500, cold storage tank 510, heat storage tank 520, heat exchange medium cooler 530, first heat exchange pipeline 540, second heat exchange pipeline 550, third heat exchange pipeline 560, fourth heat exchange pipeline 570, first heat exchange medium circulation pump 580, second heat exchange medium circulation pump 581, first valve 610, second valve 620, third valve 630, fourth valve 640, fifth valve 650, sixth valve 660, seventh valve 670, eighth valve 6200, pool 710, first recovery pipeline 720, second recovery pipeline 730, third recovery pipeline 740, fourth recovery pipeline 750, fifth recovery pipeline 760, sixth recovery pipeline 770, auxiliary heating element 810, heating pipeline 820.

DETAILED DESCRIPTION OF THE EMBODIMENTS

In order to make the above objectives, features, and advantages of the present disclosure more apparent and understandable, specific implementations of the present disclosure will be described in detail with reference to the accompanying drawings. In the following description, numerous specific details are set forth in order to provide a thorough understanding of the present disclosure. However, the present disclosure can be implemented in many other ways different from those described herein, and such modifications may be made by those skilled in the art without departing from the concept of the disclosure. Therefore, the present disclosure is not to be limited to the specific embodiments disclosed below.

In the description of the present disclosure, it should be understood that the terms "center", "longitudinal", "lateral", "length", "width", "thickness", "upper", "lower", "front", "back", "left", "right", "vertical", "horizontal", "top", "bottom", "inner", "outer", "clockwise", "counterclockwise", "axial", "radial", "circumferential" and other indicated orientations or positional relationships are based on the orientations or positional relationships shown in the accompanying drawings, and are only for the convenience of describing the present disclosure and simplifying the description, rather than indicating or implying the indicated device or elements must have a particular orientation, or constructing and operating in a particular orientation, and are therefore not to be construed as limitations of the present disclosure.

In addition, the terms "first" and "second" are only used for descriptive purposes, and should not be construed as indicating or implying relative importance or implying the number of indicated technical features. Thus, a feature delimited with "first" or "second" may expressly or implicitly include at least one such feature. In the description of the present disclosure, "a plurality of" means at least two, such as two, three, etc., unless otherwise expressly and specifically defined.

In the present disclosure, unless otherwise expressly specified and limited, the terms "mounted", "connected with each other", "connected", "fixed" and other terms should be understood in a broad sense, for example, it may be a fixed connection or a detachable connection, or integrated as one; it can be a mechanical connection or an electrical connection; it can be directly connected or indirectly connected through an intermediate medium, it can be internal communication between two elements or the interaction relationship between the two elements, unless otherwise expressly defined. For those of ordinary skill in the art, the specific meanings of the above terms in the present disclosure can be understood according to specific situations.

In the present disclosure, unless otherwise expressly specified and limited, a first feature "on" or "under" a second feature may be the first feature is in direct contact with the second feature, or the first feature is in indirect contact with the second feature via an intermediate medium. Furthermore, the first feature being "above", "over" and "on" the second feature may mean that the first feature is directly above or obliquely above the second feature, or simply means that the first feature has a higher level than the second feature. The first feature being "below", "beneath" or "under" the second feature may mean that the first feature is directly below or obliquely below the second feature, or simply means that the first feature has a lower level than the second feature.

It should be noted that when an element is referred to as being "fixed to" or "disposed on" another element, it can be directly on the other element or an intermediate element may exist. When an element is considered to be "connected to" another element, it can be directly connected to another element or an intermediate element may co-exist. The terms "vertical", "horizontal", "upper", "lower", "left", "right" and similar expressions used herein are for the purpose of illustration only and do not represent the only embodiment.

Referring to FIG. 1, FIG. 1 is a schematic structural diagram of an energy storage device based on carbon dioxide gas-liquid phase change in an embodiment of the present disclosure. The energy storage device based on carbon dioxide gas-liquid phase change provided in an embodiment of the present disclosure includes components such as a gas storage reservoir 100, a liquid storage tank 200, an energy storage assembly 300, an energy release assembly 400, and a heat exchange assembly 500, etc.

The liquid storage tank 200 stores carbon dioxide in the liquid state at high pressure. The gas storage reservoir 100 stores carbon dioxide in the gas state at normal temperature and normal pressure, and the pressure and the temperature in the gas storage reservoir 100 are maintained within a certain range to meet the energy storage requirements. Specifically, a heat preservation device is provided to maintain the temperature of the gas storage reservoir 100 so that the temperature inside the gas storage reservoir 100 is maintained within a required range. According to the ideal gas state equation PV=nRT, when the temperature and the pressure are constant, the volume is directly proportional to the amount of substance. Therefore, the gas storage reservoir 100 adopts a pneumatic membrane gas storage reservoir which has a changeable volume. When carbon dioxide is charged, the volume of the gas storage reservoir 100 increases, and when carbon dioxide flows out, the volume of the gas storage reservoir 100 decreases, so as to achieve a constant pressure in the gas storage reservoir 100. It should be noted that the pressure and the temperature inside the gas storage reservoir 100 are maintained within a certain range, such that they are approximately regarded as constant values in the aforementioned analysis.

Specifically, the temperature $T_1$ in the gas storage reservoir 100 is in a range of 15° C.≤$T_1$≤35° C., and the difference between the pressure in the gas storage reservoir 100 and the pressure in the external atmosphere is less than 1000 Pa.

The energy storage assembly 300 is located between the gas storage reservoir 100 and the liquid storage tank 200. The carbon dioxide in the gas state flowing out of the gas storage reservoir 100 is changed into the liquid state through the energy storage assembly 300, and flows into the liquid storage tank 200. During this process, the energy storage is completed.

The energy release assembly 400 is also located between the gas storage reservoir 100 and the liquid storage tank 200. The carbon dioxide in the liquid state flowing out of the liquid storage tank 200 is changed into the gas state through the energy release assembly 400, and flows into the gas storage reservoir 100. During this process, the energy stored during the energy storage process is released.

The heat exchange assembly 500 is arranged between the energy storage assembly 300 and the energy release assembly 400, and a heat exchange medium flows in the heat exchange assembly 500 to realize the energy transfer. During the energy storage process, a part of the stored energy is stored in a form of pressure energy in the carbon dioxide in the liquid state in a high-pressure state, and the other part of the stored energy is stored in a form of thermal energy in the heat exchange assembly 500. During the energy release process, this part of the energy is transferred to the energy release assembly 400 by the heat exchange assembly 500, and all the stored energy is released by the carbon dioxide in the gas state.

The energy storage device based on carbon dioxide gas-liquid phase change in this embodiment can realize the change of carbon dioxide from the gas state to the liquid state through the excess power output by the power plant during the trough period of electricity consumption, and the energy is stored. During the peak period of electricity consumption, this part of the energy is released to drive the electric generator to generate electricity. In this way, not only the energy waste can be reduced, but also the electricity price difference between the trough period and the peak period of electricity consumption can be earned, and the economic benefits are considerable.

In the energy storage device based on carbon dioxide gas-liquid phase change in this embodiment, carbon dioxide only changes between the gas state and the liquid state. Before the energy storage, the carbon dioxide is in the gas state and is at normal temperature and normal pressure. Compared with the conventional energy storage and energy release of supercritical carbon dioxide, the requirements for the gas storage reservoir 100 in this embodiment are lower, and there is no need to set up storage components with complex structures, which can reduce costs to a certain extent.

In the energy storage device based on carbon dioxide gas-liquid phase change in this embodiment, during the aforementioned energy storage process and energy release process, in the energy storage process, in addition to the energy that needs to be stored are generated, some excess energies will be further generated in some steps, and the same applies in the release process. Usually, these energies are released directly, which accumulate and result in a large energy waste. In this embodiment, these excess energies are recovered for use again such that they can be used when changing carbon dioxide from the liquid state to the gas state. In this way, the energy waste in the energy storage process and the energy release process can be reduced, which improves the energy utilization rate, and reduces the cost.

For example, the excess energies are the energy released when carbon dioxide is changed from the gas state to the liquid state, the energy released when carbon dioxide is cooled before it enters the gas storage reservoir 100, and the energy released when the heat exchange medium is cooled. At least one of these energies is capable of being recovered by a heat recovery assembly and used when carbon dioxide is changed from the liquid state to the gas state.

In some embodiments, the energy storage assembly 300 includes components such as a compressor 310, an energy storage heat exchanger 320, and a condenser 330. The compressor 310 and the gas storage reservoir 100 are connected through a first energy storage pipeline 340. The energy storage heat exchanger 320 and the compressor 310 are connected through a second energy storage pipeline 350. The condenser 330 and the energy storage heat exchanger 320 are connected through a third energy storage pipeline 360. The liquid storage tank 200 and the condenser 330 are connected through a fourth energy storage pipeline 370.

The heat exchange assembly 500 is connected to the energy storage heat exchanger 320. Part of the energy generated by the compressor 310 compressing the carbon dioxide is stored in the form of pressure energy in the high-pressure carbon dioxide, and part of the energy is transferred to and temporarily stored in the heat exchange assembly 500 in the form of thermal energy through the energy storage heat exchanger 320.

One energy storage heat exchanger 320 is connected to one compressor 310 correspondingly, and they two can be considered as a compressed energy storage part. Preferably, a plurality of compressed energy storage parts sequentially connected may be provided between the gas storage reservoir 100 and the condenser 330. Thus, the carbon dioxide is gradually pressurized by multistage compression. When a plurality of compressors 310 are provided, compressors with a smaller compression ratio can be adopted, thereby reducing the cost of the compressors 310. The compressor in the compression energy storage part at the starting end is connected to the gas storage reservoir 100, the energy storage heat exchanger in the compression energy storage part at the tail end is connected to the condenser 330, and the energy storage heat exchanger in each of the compression energy storage parts is connected to the compressor in an adjacent compression energy storage part. The starting end and the tail end here are defined by a direction from the gas storage reservoir 100 through the energy storage assembly 300 to the liquid storage tank 200. If there is only one compressed energy storage part, this only one compressed energy storage part is both the starting end and the tail end.

In some embodiments, the energy release assembly 400 includes components such as an evaporator 410, an energy release heat exchanger 420, an expander 430, and an energy release cooler 440. The evaporator 410 and the liquid storage tank 490 are connected through a first energy release pipeline 450. The energy release heat exchanger 420 and the evaporator 410 are connected through a second energy release pipeline 460. The expander 430 and the energy release heat exchanger 420 are connected through a third energy release pipeline 470. The energy release cooler 440 and the expander 430 are connected through a fourth energy release pipeline 480. The gas storage reservoir 100 and the energy release cooler 440 are connected through a fifth energy release pipeline 490.

The heat exchange assembly 500 is connected to the energy release heat exchanger 420. During the energy release process, the energy temporarily stored in the heat exchange assembly 500 is transferred through the energy release heat exchanger 420 to the carbon dioxide in the gas state that flows through the energy release heat exchanger 420. This part of energy is absorbed by the carbon dioxide and is then released through the expander 430.

In the energy release assembly 400, the energy stored during the energy storage process is released through the expander 430 to drive the electric generator 4110 to generate electric power. The carbon dioxide in the gas state, when flowing through the expander 430, impacts the vanes and drives the rotor to rotate, thereby realizing energy output.

One expander 430 is connected to one energy release heat exchanger 420 correspondingly, they two can be considered as an expansion energy release part. Preferably, a plurality of expansion energy release parts sequentially connected may be provided between the evaporator 410 and the energy release cooler 440. In this way, the manufacturing requirements for blades of the expander 430 are lower and, correspondingly, the cost thereof is lower. Among them, the energy release heat exchanger in the expansion energy release part at the starting end is connected to the evaporator 410. The expander in the expansion energy release part at the tail end is connected to the energy release cooler 440. The expander in each of the expansion energy release parts is connected to the energy release heat exchanger in an adjacent expansion energy release part. The starting end and the tail end here are defined in a direction from the liquid storage tank 200 through the energy release assembly 400 to the gas storage reservoir 100. If there is only one expansion energy release part, this only one expansion energy release part is both the starting end and the tail end.

In some embodiments, the heat exchange assembly 500 includes a cold storage tank 510, a heat storage tank 520, and a heat exchange medium cooler 530. A heat exchange medium is stored in the cold storage tank 510 and the heat storage tank 520. The temperature of the heat exchange medium in the cold storage tank 510 is lower, and the temperature of the heat exchange medium in heat storage tank 520 is higher. The cold storage tank 510 and the heat storage tank 520 form a heat exchange circuit between the energy storage assembly 300 and the energy release assembly 400. The heat exchange medium is capable of realizing heat collection and heat release when flowing in the heat exchange circuit.

Specifically, when the heat exchange medium flows from the cold storage tank 510 to the heat storage tank 520, a part of the heat generated during the energy storage process is transferred to the heat exchange assembly 500 and stored in the heat storage tank 520. When the heat exchange medium flows from the heat storage tank 520 to the cold storage tank 510, the heat stored temporarily in the heat exchange assembly 500, that is, the heat storage tank 520, during the energy storage process, is released again. When flowing from the heat storage tank 520 to the cold storage tank 510, the heat exchange medium flows through the heat exchange medium cooler 530 to be cooled down to meet the temperature requirements of the heat exchange medium stored in the cold storage tank 510. The aforementioned heat exchange medium may adopt substances such as molten salt or saturated water.

In addition, components such as circulation pumps are provided on each of the aforementioned pipelines to realize the directional flow of the carbon dioxide and the heat exchange medium.

In some embodiments, during the energy storage, the first valve 610 and the third valve 630 are turned on, and the second valve 620 and the fourth valve 640 are turned off. The carbon dioxide in the gas state at normal temperature and normal pressure flows out of the gas storage reservoir 100 and flows to the compressor 310 through the first energy storage pipeline 340, and the excess power output from the power grid drives the compressor 310 to work through the motor 380. A compression is performed on the carbon dioxide in the gas state by the compressor 310 to increase the pressure of the carbon dioxide in the gas state. During the compression process, heat is generated, which increases the temperature of the carbon dioxide. After being compressed by the compressor 310, the carbon dioxide flows to the energy storage heat exchanger 320 through the second energy storage pipeline 350, transferring the heat generated by the compression to the energy storage heat exchanger 320. The energy storage heat exchanger 320 transfers the heat to the heat exchange assembly 500, completing part of the heat storage. After realizing heat exchange, the high-pressure carbon dioxide in the gas state flows to the condenser 330 through the third energy storage pipeline 360, and is condensed and changed into carbon dioxide in the liquid state through the condenser 330. The carbon dioxide in the liquid state flows into the liquid storage tank 200 through the fourth energy storage pipeline 370, completing the energy storage process.

In the aforementioned process, the excess power output from the power grid drives the compressor 310 to work, realizing the energy input. After compressing the carbon dioxide by the compressor 310, a part of the input electric energy is stored in the form of pressure energy in the high-pressure carbon dioxide and enters the liquid storage tank 200, and a part of the electric energy is stored in the form of thermal energy in the heat exchange assembly 500. That is, in the energy storage process, the input electric energy is stored in the form of pressure energy and thermal energy.

During the energy release process, the second valve 620 and the fourth valve 640 are turned on, and the first valve 610 and the third valve 630 are turned off. The high-pressure carbon dioxide in the liquid state flows out of the liquid storage tank 200 and flows to the evaporator 410 through the first energy release pipeline 450, and is evaporated and changed into the gas state through the evaporator 410. The carbon dioxide in the gas state flows to the energy release heat exchanger 420 through the second energy release pipeline 460. The heat stored in the heat exchange assembly 500 during the energy storage process is transferred through the energy release heat exchanger 420 to the carbon dioxide that flows through the energy release heat exchanger 420, and the carbon dioxide absorbs this part of heat and the temperature thereof is increased. The high-temperature carbon dioxide in the gas state flows to the expander 430 through the third energy release pipeline 470, and expands inside the expander 430 and applies work externally to realize energy output, driving the electric generator 4110 to generate electricity.

The pressure and the temperature of the carbon dioxide are reduced after the energy release, but the temperature thereof is still higher than the storage temperature required by the gas storage reservoir 100. Thus, the carbon dioxide flowing out of the expander 430 flows into the energy release cooler 440 through the fourth energy release pipeline 480 and the temperature of the carbon dioxide is decreased by the energy release cooler 440 to make the temperature of the carbon dioxide meet the requirement of the gas storage reservoir 100. The temperature-decreased carbon dioxide flows into the gas storage reservoir 100 through the fifth energy release pipeline 490, completing the entire energy release process.

In the aforementioned process, the thermal energy stored in the heat exchange assembly 500 is transferred into the high-pressure carbon dioxide, and the carbon dioxide expands in the expander 430, releasing the pressure energy together with the thermal energy, and converting the pressure energy and the thermal energy into mechanical energy.

In the aforementioned energy storage process and energy release process, the first heat exchange medium circulation pump 580 is turned on during the energy storage, and the second heat exchange medium circulation pump 581 is turned on during the energy release. The heat exchange medium circulates between the cold storage tank 510 and the heat storage tank 520 to realize temporary storage and release of the energy. Specifically, the energy is temporarily stored in the form of heat in the heat exchange medium. In the energy storage process, the low-temperature heat exchange medium flows through the first heat exchange pipeline 540 to the energy storage heat exchanger 320 for heat exchange, and absorbs the heat in the compressed high-temperature carbon dioxide, so that the temperature of the heat exchange medium is increased. The temperature-increased high-temperature heat exchange medium flows to the heat storage tank 520 through the second heat exchange pipeline 550, and the heat is temporarily stored in the heat storage tank 520. When the energy release starts, the high-temperature heat exchange medium flows from the heat storage tank 520 through the third heat exchange pipeline 560 to the energy release heat exchanger 420 for heat exchange, transferring the heat to the carbon dioxide flowing through the energy release heat exchanger 420 to increase the temperature of the carbon dioxide. After the heat exchange is completed, the temperature of the heat exchange medium decreases, and the temperature-decreased heat exchange medium flows to the heat exchange medium cooler 530 through the fourth heat exchange pipeline 570. Although the temperature of the heat exchange medium is decreased after the heat exchange, the temperature thereof is still higher than the temperature range required by the cold storage tank 510. Therefore, the temperature of the heat exchange medium is decreased again by the heat exchange medium cooler 530 when the heat exchange medium flowing through the heat exchange medium cooler 530, to make the temperature thereof meets the requirement of the cold storage tank 510.

In addition, in some embodiments, the first valve 610, the second valve 620, the third valve 630, and the fourth valve 640 may be all turned on, and the energy storage and the energy release may be performed simultaneously. This may be the case at the end of the trough period of electricity consumption and the beginning of the peak period of electricity consumption. At this time, the carbon dioxide in the gas state at normal temperature and normal pressure flows out of the gas storage reservoir 100 to the compressor 310 through the first energy storage pipeline 340, and the power output from the power grid can drive the compressor 310 to work through the motor 380. By performing compression on the carbon dioxide in the gas state by the compressor 310, the pressure of the carbon dioxide in the gas state is increased. During the compression process, heat is generated, which increases the temperature of the carbon dioxide. After being compressed by the compressor 310, the carbon dioxide flows to the energy storage heat exchanger 320 through the second energy storage pipeline 350, transferring the heat generated by the compression to the energy storage heat exchanger 320. The energy storage heat exchanger 320 transfers the heat to the heat exchange assembly 500, completing part of the heat storage. After realizing heat exchange, the high-pressure carbon dioxide in the gas state flows to the condenser 330 through the third energy storage pipeline 360 and is condensed and changed into carbon dioxide in the liquid state through the condenser 330. The carbon dioxide in the liquid state flows into the liquid storage tank 200 through the fourth energy storage pipeline 370, completing the energy storage process. Meanwhile, the high-pressure carbon dioxide in the liquid state flows out of the liquid storage tank 200 to the evaporator 410 through the first energy release pipeline 450, and is evaporated and changed into the gas state through the evaporator 410. The carbon dioxide in the gas state flows to the energy release heat exchanger 420 through the second energy release pipeline 460. The heat stored in the heat exchange assembly 500 during the energy storage process is transferred through the energy release heat exchanger 420 to the carbon dioxide that flows through the energy release heat exchanger 420, and the carbon dioxide absorbs this part of heat and the temperature thereof is increased. The high-temperature carbon dioxide in the gas state flows to the expander 430 through the third energy release pipeline 470, and expands in the expander 430 and applies work externally to realize energy output, driving the electric generator 4110 to generate power. In this process, the rotational speed of the turbine generator is controllable, which can stabilize the power output frequency and is conducive to the frequency regulation of the power grid.

Preferably, in some embodiments, after the temperature of the heat exchange medium has been decreased by the heat exchange medium cooler 530, this part of heat released may be recovered for use in the evaporation of the carbon dioxide, so as to reduce energy waste and improve energy utilization.

Specifically, the heat exchange medium cooler 530 may be connected to the evaporator 410 to transfer the heat released when the temperature of the heat exchange medium is decreased by the heat exchange medium cooler 530 to the evaporator 410 for use in the evaporation of carbon dioxide. The heat exchange medium cooler 530 is connected to the evaporator 410 through the aforementioned heat recovery assembly.

Of course, if only the heat released when the temperature of the heat exchange medium is decreased by the heat exchange medium cooler 530 is used for the evaporation, the heat may be insufficient. Therefore, an external heat source may also be used to supplement the heat such that the evaporation process can proceed smoothly.

Preferably, the supplementary external heat source may be some waste heat, such as the heat released when the casting or forging of the casting factory or the forging factory is cooled. Using the waste heat as external heat source can reduce energy waste, and do not need additional heating, which can reduce cost.

In some embodiments, during the energy storage process, the heat released by the condensation of the condenser 330 is recycled. During the energy release process, this part of heat is supplied to the evaporator 410 for use in the evaporation of the carbon dioxide, so as to reduce energy waste and improve energy utilization.

Specifically, the condenser 330 may be connected to the evaporator 410 to collect the heat released when the carbon dioxide is condensed, and transfer the heat to the evaporator 410 for use in the evaporation of the carbon dioxide. The condenser 330 is connected to the evaporator 410 through the aforementioned heat recovery assembly.

Of course, if only the heat released by the condenser 330 is used for the evaporation, the heat may be insufficient. Therefore, an external heat source may also be used to supplement the heat such that the evaporation process can proceed smoothly.

Preferably, in some embodiments, a first energy release pipeline 450 and a sixth energy release pipeline 4500 are provided between the evaporator 410 and the liquid storage tank 200, a second valve 620 is provided on the first energy release pipeline 450, and a throttle expansion valve 4100 and an eighth valve 6200 are provided on the sixth energy release pipeline 4500. When the second valve 620 is turned on and the eighth valve 6200 is turned off, the first energy release pipeline 450 is passable. When the eighth valve 6200 is turned on and the second valve 620 is turned off, the sixth energy release pipeline 4500 is passable. During the energy release process, if the sixth energy release pipeline 4500 is chose to be passable, the high-pressure carbon dioxide in the liquid state flowing out of the liquid storage tank 200 is expanded and depressurized through the throttle expansion valve 4100 and then flows into the evaporator 410.

Providing the throttle expansion valve 4100 for depressurization facilitates the change of the carbon dioxide from the liquid state to the gas state, as compared with changing the carbon dioxide from the liquid state to the gas state only by inputting heat.

Preferably, in some embodiments, the evaporator 410 may be combined with the condenser 330, combining the two into one component to form a phase change heat exchanger. The phase change heat exchanger includes two parts: an evaporation part and a condensation part. The evaporation part and the condensation part are connected through a pipeline. In the phase change heat exchanger, the heat released by the condensation part during condensation is transferred to the evaporation part. After combining the evaporator 410 and the condenser 330 into one component, the heat transfer is completed inside the phase change heat exchanger, which can reduce the loss during heat transfer and further improve the energy utilization. It should be noted that the heat transfer can be realized in the aforementioned way only when the energy storage and the energy release are performed simultaneously. If the energy storage and the energy release cannot be performed simultaneously, the energy needs to be stored first and then supplied to the evaporator 410 during evaporation.

Figure 2:
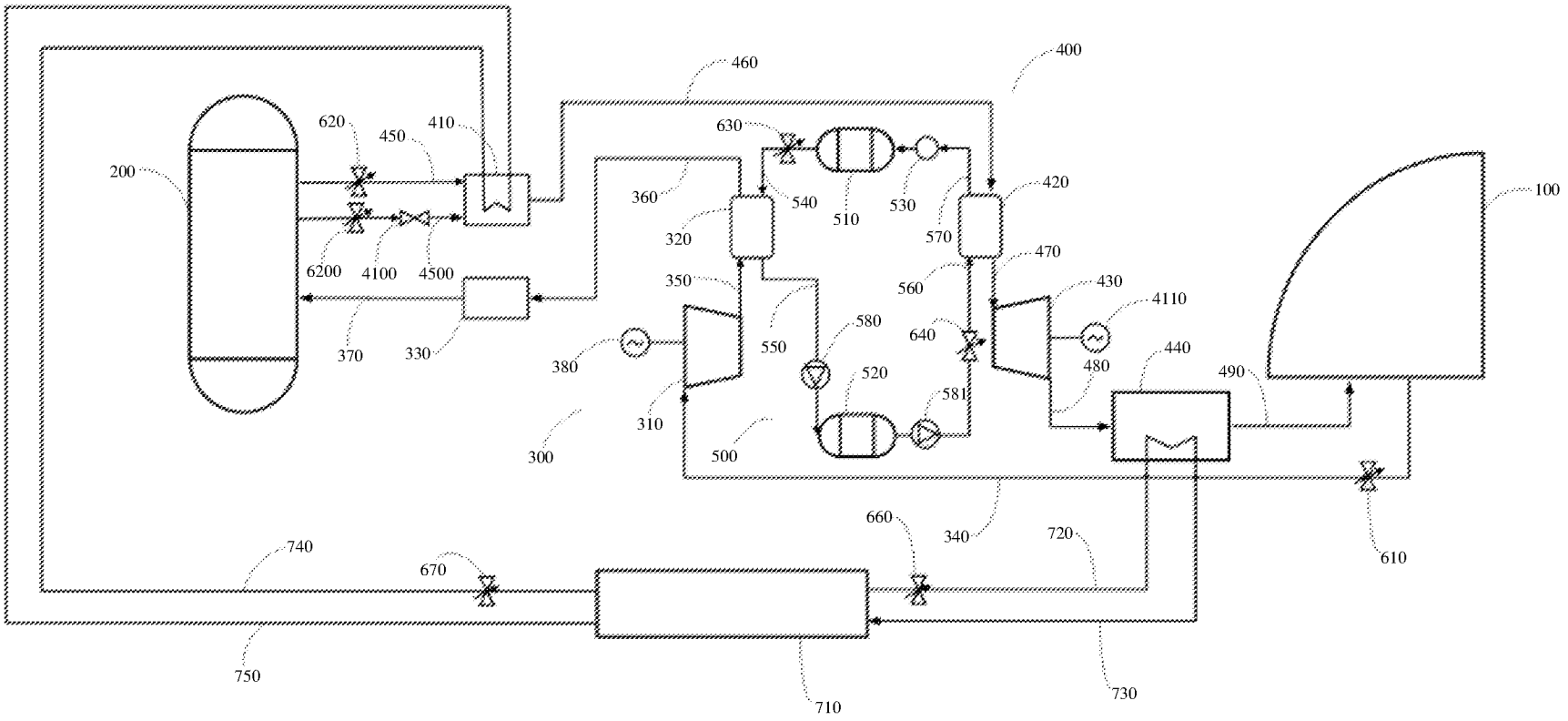
FIG. 2 is a schematic structural diagram of an energy storage device based on carbon dioxide gas-liquid phase change in another embodiment of the present disclosure.

Referring to FIG. 2, a schematic structural diagram of an energy storage device based on carbon dioxide gas-liquid phase change in another embodiment of the present disclosure is shown. As previously mentioned, in the energy release process, the carbon dioxide flowing out of the expander 430 flows into the energy release cooler 440 through the fourth energy release pipeline 480 and the temperature of the carbon dioxide is decreased by the energy release cooler 440 to meet the requirement of gas storage reservoir 100. Heat is released when the temperature is decreased with heat exchange by the energy release cooler 440. Preferably, in some embodiments, this part of heat may be recycled for use in the evaporation of the carbon dioxide, so as to reduce energy waste and improve energy utilization.

Specifically, the energy release cooler 440 may be connected to the evaporator 410 to transfer the heat, released during the temperature decreasing with heat exchange by the energy release cooler 440, to the evaporator 410 for use in the evaporation of the carbon dioxide. The energy release cooler 440 is connected to the evaporator 410 through the aforementioned heat recovery assembly.

The evaporator 410 is connected to the heat recovery assembly, and the recovered heat is input to the evaporator 410 through the heat recovery assembly.

Specifically, the aforementioned heat recovery assembly may only include a recovery pipeline, and at least one of the energy release cooler 440, the condenser 330, and the heat exchange medium cooler 530 is connected to the evaporator 410 through the recovery pipeline. It should be noted that there may be a plurality of recovery pipelines. When the heat of two or three of the aforementioned energy release cooler 440, condenser 330, and heat exchange medium cooler 530 is recovered, the energy release cooler 440, the condenser 330 and the heat exchange medium cooler 530 are connected to the evaporator 410 through a part of the recovery pipelines respectively.

Alternatively, the aforementioned heat recovery assembly may include recovery pipelines and an intermediate storage element. The evaporator 410 is connected to the intermediate storage element through a part of the recovery pipelines, and at least one of the energy release cooler 440, the condenser 330, and the heat exchange medium cooler 530 is connected to the intermediate storage element through a part of the recovery pipelines.

For example, in FIG. 2, the intermediate storage element is a pool 710. The energy release cooler 440 and evaporator 410 realize heat transfer via the pool 710. A first recovery pipeline 720 and a second recovery pipeline 730 are provided between the pool 710 and the energy release cooler 440. A third recovery pipeline 740 and a fourth recovery pipeline 750 are provided between the pool 710 and the evaporator 410. The pool 710 and the aforementioned pipelines are provided with heat preservation materials for heat preservation of water therein.

The sixth valve 660 is turned on, and water in the pool 710 flows through the first recovery pipeline 720 to the energy release cooler 440, absorbs the heat released by the energy release cooler 440, and flows through the second recovery pipeline 730 to the pool 710 after the temperature of the water has increased. In this way, the heat released by the energy release cooler 440 can be transferred to the water in the pool 710. During the evaporation, the seventh valve 670 is turned on, and the water with a higher temperature in the pool 710 flows through the third recovery pipeline 740 to the evaporator 410, to provide heat for the evaporation of the carbon dioxide. After flowing through the evaporator 410, the temperature of the water is decreased, and the temperature-decreased water flows through the fourth recovery pipeline 750 to the pool 710. As such, the heat released by the energy release cooler 440 is transferred to the evaporator 410.

In the aforementioned process, in addition to using the water for heat collection, other substances may be used.

In addition, components such as circulating pumps are further provided on the first recovery pipeline 720, the second recovery pipeline 730, the third recovery pipeline 740, and the fourth recovery pipeline 750, so as to realize the circulating flow of the water in the pool 710.

As the heat released by the energy release cooler 440 and the condenser 330 is continuously transferred to the pool 710, the temperature of the water in the pool 710 may be continuously increased. As the evaporator 410 continuously absorbs the heat from the pool 710, it may cause the temperature of the water in the pool 710 to decrease continuously. Therefore, preferably, the pool 710 is in a constant temperature state.

Specifically, the pool 710 is further connected with components such as the thermostatic controller, the temperature sensor, the heater and the radiator. The temperature sensor monitors the temperature of the water in the pool 710 and transmits the temperature of the water to the thermostatic controller. If the temperature of the water is raised by the heat released by the energy release cooler 440 for too much and exceeds the maximum set value, the thermostatic controller controls the radiator to dissipate heat from the pool 710. If the temperature of the water is reduced by the heat absorbed by the evaporator 410 for too much and is below the minimum set value, the thermostatic controller controls the heater to heat the pool 710.

Preferably, both the heat released during the condensation of the carbon dioxide and the heat released by the energy release cooler 440 may be supplied to evaporator 410 for use.

Figure 3:
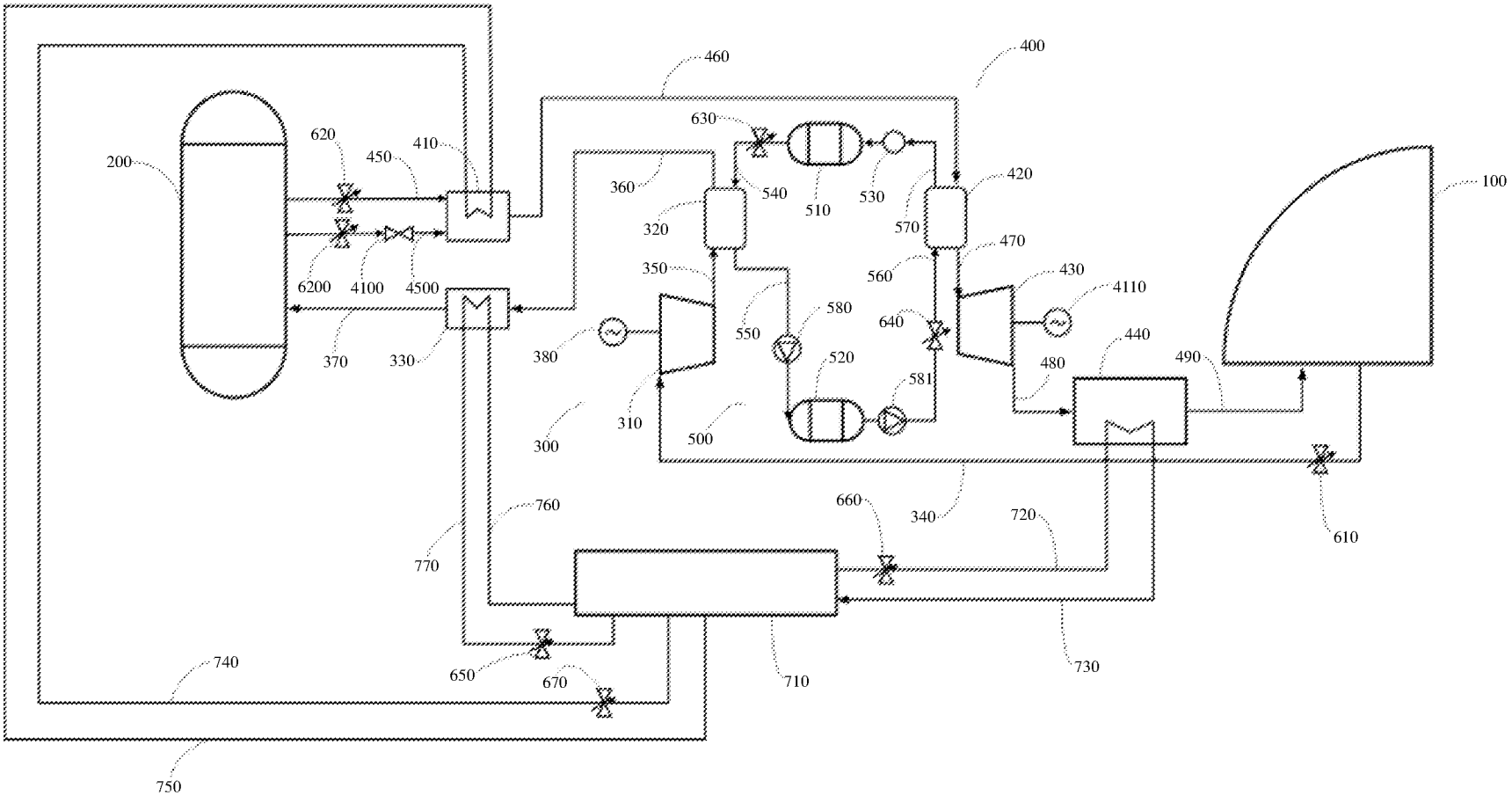
FIG. 3 is a schematic structural diagram of an energy storage device based on carbon dioxide gas-liquid phase in yet another embodiment of the present disclosure.

Referring to FIG. 3, a schematic structural diagram of an energy storage device based on carbon dioxide gas-liquid phase change in yet another embodiment of the present disclosure is shown. Specifically, a fifth recovery pipeline 760 and a sixth recovery pipeline 770 may be provided between the pool 710 and the condenser 330. The sixth valve 660 and the fifth valve 650 are turned on, a part of the water in the pool 710 flows through the fifth recovery pipeline 760 to the condenser 330, absorbs the heat released by the condenser 330, and flows through the sixth recovery pipeline 770 to the pool 710 after the temperature of the water has increased. Meanwhile, a part of the water in the pool 710 flows through the first recovery pipeline 720 to the energy release cooler 440, absorbs the heat released by the energy release cooler 440, and flows through the second recovery pipeline 730 to the pool 710 after the temperature of the water has increased.

During the evaporation, the seventh valve 670 is turned on, and the water with higher temperature in the pool 710 flows through the third recovery pipeline 740 to the evaporator 410, providing heat for the evaporation of the carbon dioxide. After passing through the evaporator 410, the temperature of the water decreases, and the cooled water flows through the fourth recovery pipeline 750 to the pool 710.

Similar to the previous embodiment, the thermostatic control is performed at pool 710, which is not described here.

In some embodiments, the heat released during condensation of carbon dioxide, the heat released by the energy release cooler 440, and the heat released by the heat exchange medium cooler 530 may also be supplied to evaporator 410 for use. The specific configuration manner is similar to the aforementioned embodiment, and will not be described here. The aforementioned three kind of heat may be supplied separately, or two of them may be supplied together.

Of course, if there is still a shortage after supplying the aforementioned three kinds of heat to the evaporator 410, an external heat source may be used to supplement the heat.

Specifically, when an external heat source is used to supplement the heat, the heat can be directly supplemented to the evaporator 410. Alternatively, the heat may also be supplemented to the heat exchange medium of the heat exchange circuit.

Figure 4:
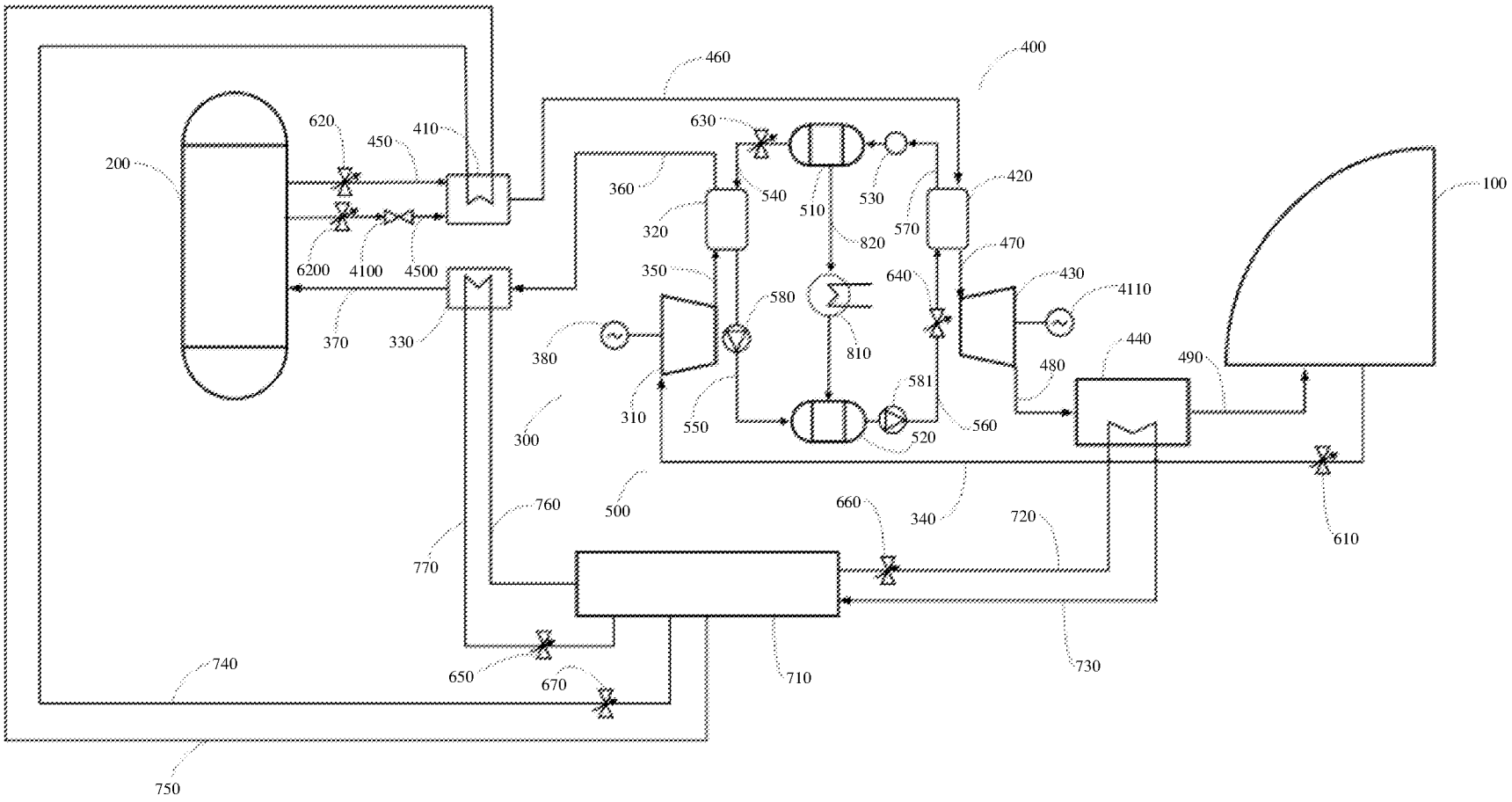
FIG. 4 is a schematic structural diagram of an energy storage device based on carbon dioxide gas-liquid phase change in yet another embodiment of the present disclosure.

Referring to FIG. 4, a schematic structural diagram of an energy storage device based on carbon dioxide gas-liquid phase change in yet another embodiment of the present disclosure is shown. A heating pipeline may be provided between the cold storage tank 510 and the heat storage tank 520, and an auxiliary heating element 810 may be provided on the heating pipeline 820. A part of the heat exchange medium flowing out of the cold storage tank 510 flows to the auxiliary heating element 810 through the heating pipeline 820, and the auxiliary heating element 810 heats the part of the heat exchange medium such that it absorbs external heat and increases the heat reaching the heat exchange medium cooler 530, that is, the heat that can be provided to the evaporator 410 is increased.

Preferably, the source of heat at the auxiliary heating element 810 may be some waste heat, such as heat released when castings or forgings of the casting factory or the forging factory are cooled. Using the waste heat as an external heat source can reduce energy waste, and do not need additional heating, which can reduce cost.

Preferably, a plurality of groups of the aforementioned energy storage assembly 300, energy release assembly 400 and heat exchange assembly 500 may be provided between the gas storage reservoir 100 and the liquid storage tank 200, and each group is arranged in the manner in the foregoing embodiments. In use, if a component in one of the groups fails, other groups can still operate, such that the failure rate of the device can be reduced and its operating reliability can be improved.

In addition, in some embodiments, an energy storage method based on carbon dioxide gas-liquid phase change is further provided. During energy storage, the carbon dioxide changes from the gas state to the liquid state, and the storage of the energy is completed by the energy storage process. During energy release, the carbon dioxide changes from the liquid state to the gas state, and the release of the energy is completed by the energy release process. At least one of the energy released when the carbon dioxide changes from the gas state to the liquid state, the energy released when the carbon dioxide is cooled before it enters the gas storage reservoir, and the energy released when the heat exchange medium is cooled, is used in the change of the carbon dioxide from the liquid state to the gas state. Therefore, the energy waste in the energy storage process and the energy release process can be reduced, which improves the energy utilization rate.

The technical features of the aforementioned embodiments may be combined arbitrarily. To simplify the description, not all the possible combinations of the technical features in the aforementioned embodiments are described. However, all of the combinations of these technical features should be considered as within the scope of the present disclosure, as long as such combinations do not contradict with each other.

The aforementioned embodiments only describe several implementations of the present disclosure, and the description thereof is more specific and detailed, but it should not be construed as restricting the scope of the present disclosure. It should be noted that, for those skilled in the art, several variations and improvements may be made without departing from the concept of the present disclosure, and these are all within the protection scope of the present disclosure. Therefore, the protection scope of the present disclosure shall be defined by the appended claims.

What is claimed is:

1. An energy storage device based on carbon dioxide gas-liquid phase change, comprising:

a gas storage reservoir, configured to store carbon dioxide in a gas state, wherein a volume of the gas storage reservoir is changeable;

a liquid storage tank, configured to store carbon dioxide in a liquid state;

an energy storage assembly, configured to store energy and arranged between the gas storage reservoir and the liquid storage tank, wherein the energy storage assembly comprising a condenser and at least one compressed energy storage part each of the at least one compressed energy storage part comprises a compressor and an energy storage heat exchanger, the carbon dioxide is changed from the gas state to the liquid state through the condenser;

an energy release assembly, configured to release energy and arranged between the gas storage reservoir and the liquid storage tank, wherein the energy release assembly comprises an evaporator at least one expansion energy release part and an energy release cooler, each of the at least one expansion erergy release part comprises an expander and an energy release heat exchanger, the carbon dioxide is changed from the liquid state to the gas state through the evaporator, and the energy release cooler is configured to cool the carbon dioxide entering the gas storage reservoir; and a heat exchange assembly, wherein the heat exchange assembly comprises a cold storage tank, a heat storage tank, and a heat exchange medium cooler, the cold storage tank and the heat storage tank are provided with a heat exchange medium, the cold storage tank and the heat storage tank form a heat exchange circuit between the energy storage assembly and the energy release assembly, the heat exchange medium is capable of flowing in the heat exchange circuit, so as to transfer part of energy generated in the energy storage assembly to the energy release assembly, and the heat exchange medium cooler is configured to cool the heat exchange medium entering the cold storage tank; and a heat recovery assembly, wherein the heat recovery assembly is connected to the evaporator, and at least one of the condenser, the energy release cooler, or the heat exchange medium cooler is connected to the heat recovery assembly, such that at least one of energy released when the carbon dioxide is changed from the gas state to the liquid state, energy released when the carbon dioxide is cooled before entering the gas storage reservoir, or the energy released when the heat exchange medium is cooled, is capable of being recovered by the heat recovery assembly and transferred to the evaporator to be used in evaporation of the carbon dioxide in the evaporator.

2. The energy storage device based on carbon dioxide gas-liquid phase change according to claim 1, wherein the energy release assembly further comprises a throttle expansion valve located between the liquid storage tank and the evaporator, and the throttle expansion valve is configured to expand and depressurize the carbon dioxide flowing out of the liquid storage tank.

3. The energy storage device based on carbon dioxide gas-liquid phase change according to claim 1, wherein the evaporator and the condenser are combined to form a phase change heat exchanger.

4. The energy storage device based on carbon dioxide gas-liquid phase change according to claim 1, wherein the energy storage heat exchanger is connected to the compressor in each compressed energy storage part, the energy storage heat exchanger in each compressed energy storage part is connected to the compressor in an adjacent compressed energy storage part, the compressor in the compressed energy storage part at the starting end is connected to the gas storage reservoir, the energy storage heat exchanger in the compressed energy storage part at the tail end is connected to the condenser, the liquid storage tank is connected to the condenser, the heat exchange assembly is connected to the energy storage heat exchanger, and the energy storage heat exchanger is capable of transferring part of energy generated during compression of carbon dioxide by the compressor to the heat exchange assembly.

5. The energy storage device based on carbon dioxide gas-liquid phase change according to claim 1, wherein the expander is connected to the energy release heat exchanger in each expansion energy release part, the expander in each expansion energy release part is connected to the energy release heat exchanger in an adjacent expansion energy release part, the evaporator is connected to the liquid storage tank, the energy release heat exchanger in the expansion energy release part at a starting end is connected to the evaporator, the expander in the expansion energy release part at a tail end is connected to the energy release cooler, the gas storage reservoir is connected to the energy release cooler, the heat exchange assembly is connected to the energy release heat exchanger, and the carbon dioxide flowing through the energy release heat exchanger is capable of absorbing energy temporarily stored in the heat exchange assembly.

6. The energy storage device based on carbon dioxide gas-liquid phase change according to claim 1, wherein the heat exchange medium is capable of storing part of energy generated by the energy storage assembly when the heat exchange medium flows from the cold storage tank to the heat storage tank, and the heat exchange medium is capable of transferring the stored energy to the energy release assembly when the heat exchange medium flows from the heat storage tank to the cold storage tank.

7. The energy storage device based on carbon dioxide gas-liquid phase change according to claim 1, wherein an auxiliary heating element is provided between the cold storage tank and the heat storage tank, and part of the heat exchange medium is capable of being heated by the auxiliary heating element and then flowing into the heat storage tank.

8. The energy storage device based on carbon dioxide gas-liquid phase change according to claim 1, wherein the heat recovery assembly comprises an intermediate storage element and recovery pipelines, the intermediate storage element is connected to the evaporator through part of the recovery pipelines, and at least one of the energy released when the carbon dioxide is changed from the gas state to the liquid state, the energy released when the carbon dioxide is cooled before entering the gas storage reservoir, and the energy released when the heat exchange medium is cooled, is capable of reaching the intermediate storage element through part of the recovery pipelines.

9. The energy storage device based on carbon dioxide gas-liquid phase change according to claim 8, wherein a heat collection medium is provided within the intermediate storage element and the recovery pipelines, and is capable of flowing between the intermediate storage element and the evaporator, the condenser, the energy release cooler, and the heat exchange medium cooler through the recovery pipelines.

10. The energy storage device based on carbon dioxide gas-liquid phase change according to claim 1, wherein the gas storage reservoir is a flexible pneumatic membrane gas storage reservoir.

11. An energy storage method based on carbon dioxide gas-liquid phase change, performed by the energy storage device according to claim 1, the energy storage method comprising an energy storage step and an energy release step; wherein in the energy storage step, carbon dioxide is changed from a gas state to a liquid state, and part of energy is stored in a heat exchange medium;

in the energy release step, carbon dioxide is changed from the liquid state to the gas state, the energy stored in the heat exchange medium is released through the carbon dioxide, and at least one of energy released when the carbon dioxide is changed from the gas state to the liquid state, energy released when the carbon dioxide is cooled before entering the gas storage reservoir, and energy released when the heat exchange medium is cooled, is used in evaporation of the carbon dioxide.

12. The energy storage method based on carbon dioxide gas-liquid phase change according to claim 11, wherein the energy release step and the energy storage step are performed simultaneously.

13. The energy storage method based on carbon dioxide gas-liquid phase change according to claim 11, wherein all of the energy released when the carbon dioxide is changed from the gas state to the liquid state, the energy released when the carbon dioxide is cooled before entering the gas storage reservoir, and the energy released when the heat exchange medium is cooled, are used in evaporation of the carbon dioxide.

14. The energy storage device based on carbon dioxide gas-liquid phase change according to claim 1, wherein the energy storage assembly and the energy release assembly are configured to be capable of operating simultaneously, so that an energy storage step in which the energy storage assembly operates and an energy release step in which the energy release assembly operates are capable of being performed simultaneously.

15. The energy storage device based on carbon dioxide gas-liquid phase change according to claim 1, wherein a first flowing path allowing the carbon dioxide to flow from the gas storage reservoir to the liquid storage tank therewithin and a second flowing path allowing the carbon dioxide to flow from the liquid storage tank to the gas storage reservoir therewithin are formed between the gas storage reservoir and the liquid storage tank respectively; the first flowing path passes through the compressor, the energy storage heat exchanger, and the condenser; and the second flowing path passes through the evaporator, the energy release heat exchanger, the expander, and the energy release cooler.

16. The energy storage device based on carbon dioxide gas-liquid phase change according to claim 1, wherein the condenser, the energy release cooler, and the heat exchange medium cooler are all connected to the heat recovery assembly, such that the energy released when the carbon dioxide is changed from the gas state to the liquid state from the condenser, the energy released when the carbon dioxide is cooled before entering the gas storage reservoir from the energy release cooler, and the energy released when the heat exchange medium is cooled from the heat exchange medium cooler, are all capable of being recovered by the heat recovery assembly and transferred to the evaporator to be used in evaporation of the carbon dioxide in the evaporator.

* * * * *